US005987651A

United States Patent [19]

Tanaka

[11] Patent Number: 5,987,651

[45] Date of Patent: Nov. 23, 1999

[54] MECHANISM FOR ATTACHING A ROTATING PLATE IN A HELMET

[75] Inventor: Haruo Tanaka, Ichikawa, Japan

[73] Assignee: Shoei Kako Co., Ltd., Tokyo, Japan

[21] Appl. No.: 08/989,309

[22] Filed: Dec. 12, 1997

[30] Foreign Application Priority Data

Dec. 17, 1996 [JP] Japan ..... 8-353568

[51] Int. Cl.[6] ..... A42B 3/22

[52] U.S. Cl. ..... 2/424; 2/425

[58] Field of Search ..... 2/6.3, 6.5, 6.7, 2/424, 425

[56] References Cited

U.S. PATENT DOCUMENTS 4,920,585 5/1990 Arai ..... 2/424

*Primary Examiner*—Diana Oleksa

*Attorney, Agent, or Firm*—Hopgood Calimafde Kalil & Judlowe

[57] ABSTRACT

In accordance with one aspect of this invention, in a mechanism for attaching a rotating plate in a helmet, a positioning member which is of substantially tubular shape and relatively slidable along a guide groove provided in the rotating plate such as a shield plate and shaped into a nearly circular arc has an easily bendable portion provided between a first cut and a second cut which are formed in substantially opposed relation to each other at the upper end and the lower end of the positioning member, respectively. In accordance with another aspect of this invention, in a mechanism for attaching a rotating plate in a helmet, the three engaged openings provided in the guide groove so as to keep in the fully closed condition, in the fully opened condition, and in the defrosted condition, respectively, can relatively hold the positioning member to almost remain its original form, and the arcuated groove disposed in the guide groove can relatively hold the positioning member so as to deform it elastically.

29 Claims, 6 Drawing Sheets

MECHANISM FOR ATTACHING A ROTATING PLATE IN A HELMET

TECHNICAL FIELD

The present invention relates to a helmet having a head protector for protecting the head of a person with a helmet on, such as a rider on a motor-bicycle, and particularly to a mechanism for attaching a rotating plate, such as a shield plate or a visor available for a windshield and/or a sunshade, to the head protector so as to be rotatable within a predetermined angular range.

BACKGROUND OF THE INVENTION

Such a mechanism for attaching the rotating plate as described above is disclosed, for example, in Japanese Utility Model Registration Publication No. 57-13302.

The mechanism for attaching the rotating plate to the head protector in the helmet, disclosed in Japanese Utility Model Registration Publication No. 57-13302 (hereinafter described as "the conventional mechanism for attaching the shield plate") has a narrow base plate attached to the front side of the head protector of the helmet. Rotatably attached to this base plate are the right and left sides of a shield plate with a pair of right and left attaching shafts, respectively. Further, an intermediate plate lies between the base plate and the shield plate, and a protrusion projecting from the outer side surface of the intermediate plate and serving as a stopper is fitted into an opening of the shield plate, so that the intermediate plate is rotatable together with the shield plate.

Moreover, in the conventional mechanism for attaching the shield plate, a circular-arcuate guide groove whose center coincides with that of the attaching shaft is disposed in the base plate, and fitted into this guide groove is a resilient cylinder, projecting from and formed integral with the inner side of the intermediate plate. The circular-arcuate guide groove is shaped from a plurality of circular openings which are shifted a little in turn and partially overlapped, so that a narrow part is formed between the adjacent openings.

In the conventional mechanism for attaching the shield plate constituted as described above, when the shield plate is moved to open or close the head protector, the resilient cylinder is moved along the circular-arcuate guide groove and fitted into one of the plurality of circular openings, so that it is possible to set the shield plate in its predetermined position that shows a one-to-one correspondence with each of the plurality of circular openings (that is, fully closed position, one-sixth opened position, one-third opened position, half-opened position, two-thirds-opened position, five-sixths opened position, or fully opened position).

However, in the conventional mechanism for attaching the shield plate, the shield plate can be merely set in its predetermined position that corresponds with one of the plurality of circular openings of the circular-arcuated guide groove, so that the shield plate can not be set in an arbitrarily opened position with respect to the head protector of the helmet. Further, when the shield plate is largely moved to open or close with respect to the head protector of the helmet, it is required to move the resilient cylinder wobblingly along the plurality of circular openings and the plurality of narrow parts, so that well clicking responses are not brought when the shield plate is thus moved.

SUMMARY OF THE INVENTION

Accordingly, it is an object of the present invention to provide a mechanism for attaching a rotating plate in a helmet, in which the operation of the positioning member sliding relatively along the guide groove is made sure enough, though its constitution is very simple.

Another object of the present invention is to provide a mechanism for attaching a rotating plate in a helmet, in which the rotating plate can be set sure enough in its fully closed position, its defrosted position, and its fully opened position, and also can be set in arbitrarily opened positions intermediate between the defrosted position and the fully opened position.

A further object of the present invention is to provide a mechanism for attaching a rotating plate in a helmet, in which the opening and the closing operations of the rotating plate from its defrosted position to its fully opened position and from its fully opened position to its defrosted position can be carried out very smoothly, and the clicking response is very well at the time of opening and closing the rotating plate.

In accordance with one aspect of the present invention, a mechanism for attaching a rotating plate in a helmet, comprising a rotating plate available for a windshield and/or a sunshade, which is attached to a head protector so as to be rotatable about a predetermined pivot; an arcuated guide groove provided in the rotating plate, which is of nearly circular arc, the center of a circle partially marked out by the circular arc substantially coinciding with that of the predetermined pivot; and a substantially tubular positioning member attached to the head protector and inserted into the guide groove so as to be relatively slidable along the guide groove when the rotating plate is rotated, is characterized in that a first cut and a second cut are formed in substantially opposed relation to each other at the upper end and the lower end of the positioning member, respectively, to provide an easily bendable portion between the first cut and the second cut of the positioning member.

According to the present invention made as described above, the substantially tubular positioning member relatively slidable along the guide groove, which is provided in the rotating plate and shaped into the nearly circular arc, has the easily bendable portion between the first cut and the second cut which are formed in substantially opposed relation to each other at the upper end and the lower end of the substantially tubular positioning member, respectively, so that the operation of the substantially tubular positioning member, which slides relatively along the guide groove shaped into the nearly circular arc, can be carried out very simply and very surely. Further, in the mechanism comprising the rotating plate rotatably attached to the head protector, the guide groove provided in the rotating plate and shaped into the nearly circular arc, and the substantially tubular positioning member attached to the head protector and relatively sliding along the guide groove, which is shaped into the nearly circular arc, the easily bendable portion is provided between the first cut and the second cut which are formed in substantially opposed relation to each other at the upper end and the lower end of the substantially tubular positioning member, respectively, so that the constitution of the mechanism is very simple.

In accordance with another aspect of the present invention, a mechanism for attaching a rotating plate in a helmet, comprising a rotating plate available for a windshield and/or a sunshade, which is attached to a head protector so as to be rotatable about a predetermined pivot; an arcuated guide groove provided in the rotating plate, which is of nearly circular arc, the center of a circle partially marked out by the circular arc substantially coinciding with that of the predetermined pivot; and a substantially tubular positioning member attached to the head protector and inserted into the guide groove so as to be relatively slidable along the guide groove when the rotating plate is rotated, is characterized in that the guide groove has a first engaged opening for keeping in the fully closed condition, which is provided at one end of the guide groove, a second engaged opening for keeping in the fully opened condition, which is provided at the other end of the guide groove, a third engaged opening for keeping in the defrosted condition, which is provided to be near to and partially overlap with the first engaged opening, and an arcuated groove, which is of substantially circular arc and is substantially uniform in width and by means of which the second engaged opening and the third engaged opening communicate with each other, the center of a circle partially marked out by the circular arc substantially coinciding with that of the predetermined pivot; the substantially tubular positioning member is held by the three engaged openings so as to almost remain its original form when it is fitted into each engaged opening; and the substantially tubular positioning member is elastically deformed by the arcuated groove when it is fitted into the arcuated groove.

According to the present invention made as described above, the substantially tubular positioning member can be held so as to almost remain it original form when fitted into the engaged openings for keeping in the fully closed condition, in the defrosted condition and in the fully opened condition, respectively, and can be elastically deformed in the guide groove, which has been shaped into the substantially circular arc, so that the rotating plate can be set sure enough in its fully closed position, its defrosted position, and its fully opened position, respectively, and also can be set in arbitrarily opened positions intermediate between the defrosted position and the fully opened position. Further, the opening and the closing operations of the rotating plate from its defrosted position to its fully opened position and from its fully opened position to its defrosted position can be carried out very smoothly, and the clicking response is very well at the time of opening and closing the rotating plate.

The above, and other, objects, features and advantages of the present invention, will become readily apparent from the following detailed description thereof which is to be read in connection with the accompanying drawings.

DETAILED DESCRIPTION OF THE INVENTION

Referring to FIGS. 1–10, a first embodiment in which the present invention is applied to a shield plate attaching mechanism of a full-face-type helmet will be described hereinafter.

Figure 1:
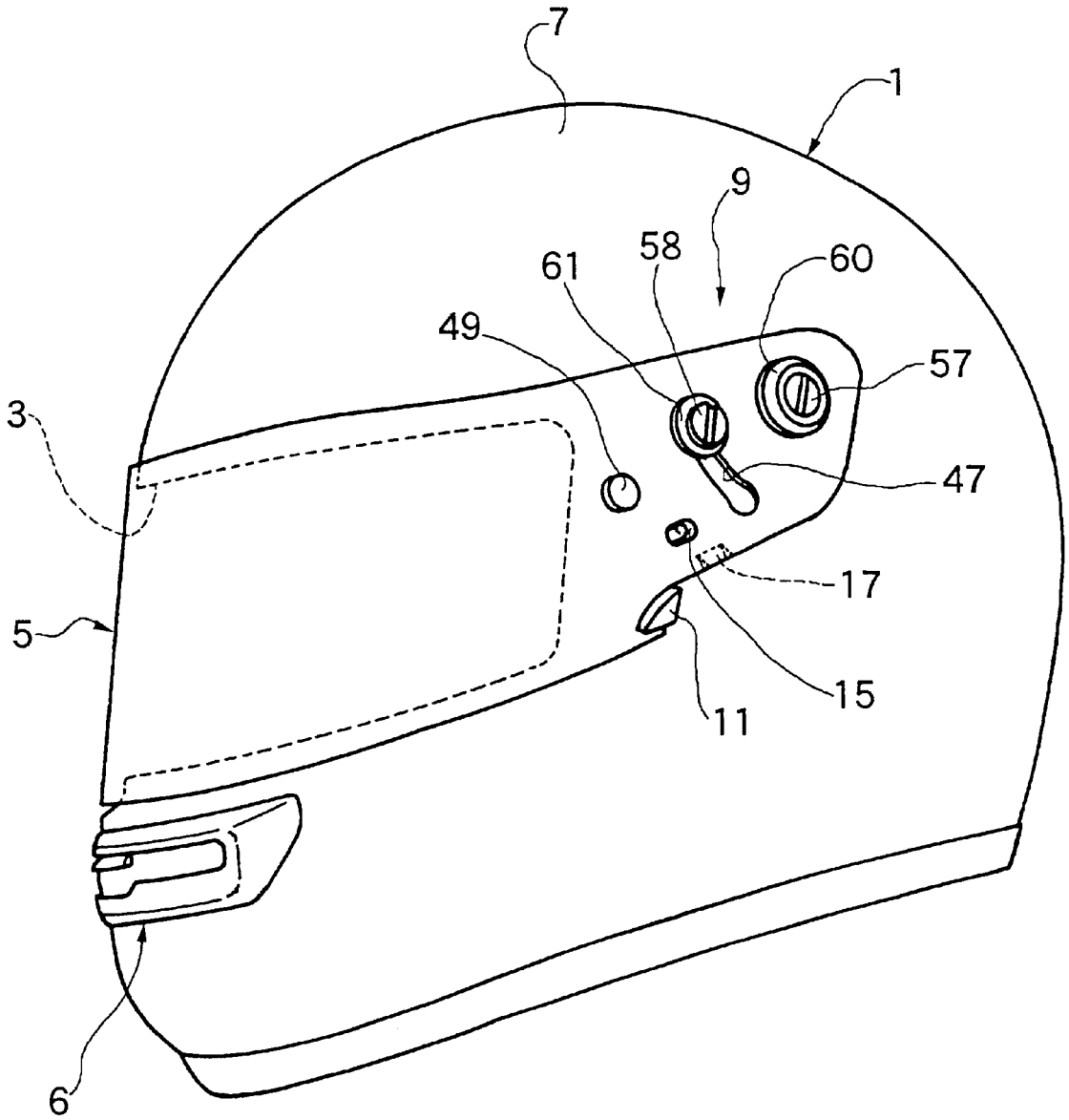
FIG. 1 is a general perspective view of a helmet according to a first embodiment, in which the present invention is applied to a shield plate attaching mechanism of a full-face-type helmet.

As shown in FIG. 1, the full-face-type helmet comprises a cap-like head protector 1 worn by a rider of a motorcycle or the like, a shield plate 5 capable of opening and closing a window opening 3 formed on the front side of the head protector 1 so as to face a portion lying between the fore head and the chin of the rider or the like with the helmet on (that is, the central portion of the face), and a pair of right and left chin straps (not shown) attached to the inner side of the head protector 1. A ventilator 6 for ventilating the inside of the head protector 1 is disposed in a portion of the head protector 1, facing the chin of the rider or the like with the helmet on. The shield plate 5 is attached to the helmet so as to be available for a windshield but, if necessary, it may be colored so as not to cut out light and used also as a sunshade (that is, a visor). The shield plate 5 may be made of transparent or translucent hard material such as polycarbonate or other hard resins. The right side and the left side of the shield plate 5 are rotatably attached to an outer shell 7, which forms the outer wall of the head protector 1, through a pair of right and left shield plate attaching mechanism 9. It is noted that the outer shell 7 may be made of high strength hard material such as FRP or other hard resins. The right shield plate attaching mechanism ("right" will be designated as "left" when the helmet is viewed from its front side) is fully symmetrical to the left shield plate attaching mechanism, except that a finger held portion 11, a female-screw member 12 (including a fitting opening provided in the outer shell 7), an engaging pin 13, an engaged aperture 15 and a guiding notch 17, which are described hereinafter, are not disposed in the right shield plate attaching mechanism, so that the explanation of the right shield plate attaching mechanism is omitted and only the explanation of the left shield plate attaching mechanism will be given.

Figure 2:
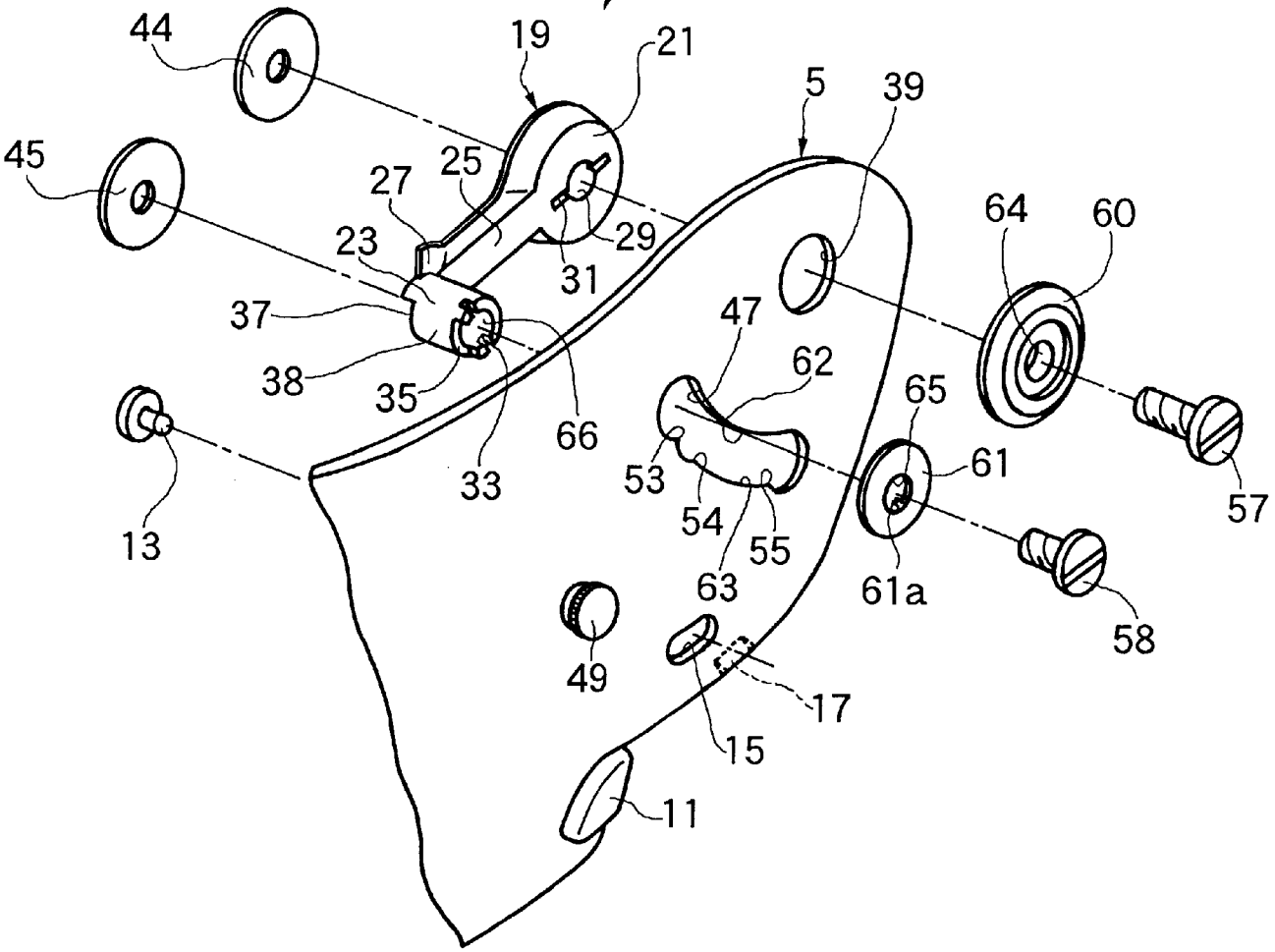
FIG. 2 is an exploded, perspective view of the shield plate attaching mechanism on the left side of the helmet of FIG. 1.
Figure 9:
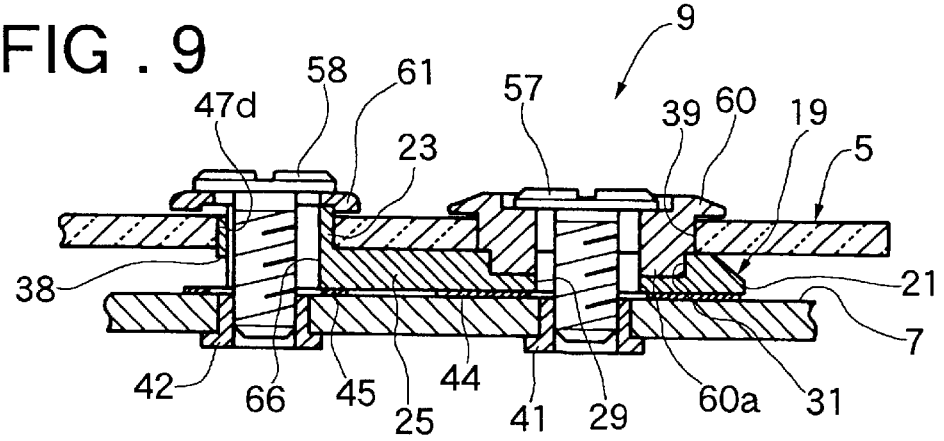
FIG. 9 is a sectional view taken along the line B—B on FIG. 4.

As shown in FIGS. 2 and 9, the left shield plate attaching mechanism 9 has an attaching member 19 which is attached to the outer shell 7 together with the shield plate 5. The attaching member 19 comprises a substantially annular base portion 21, a substantially cylindrical portion 23, which serves as the substantially tubular positioning member, a narrow strip-like connecting portion 25, which connects the base portion 21 with the cylindrical portion 23, and a pair of right and left reinforcing portions 27 that extend from the cylindrical portion 23 to the connecting portion 25 and laterally spread like gills on the right and left sides of their boundary and its vicinity. It is noted that the portions denoted by numerals 21, 23, 25 and 27 are made of a little elastic material such as polyacetal resin or other resins, and are formed integrally with one another.

Provided in the surface of the base portion 21 are a pair of right and left engaging grooves 31 each having a bottom, which are arranged in opposed relation to each other and are connected to a central aperture 29 and, in the back surface of the base portion 21, many radial ridges (not shown) for preventing slips are formed integrally with the base portion 21. Provided at the upper end of the cylindrical portion 23 are a pair of right and left engaging slits 33 which are relatively narrow in width and, between the pair of engaging slits 33, a substantially rectangular cut 35 for causing resilience lies, which is relatively wide in width. Further, provided at the lower end of the cylindrical portion 23 is a substantially rectangular cut 37 for causing resilience, which lies in opposed relation to the cut 35 along the axial direction of the cylindrical portion 23, and is relatively wide in width. Thus, an easily bendable portion 38 is formed between the cuts 35 and 37. The easily bendable portion 38 is a little narrow in width and elastically deformable.

Each of the upper cut 35 and the lower cut 37 is not necessarily of substantially rectangular shape and may be in the shape of the substantial letter U, a substantially half elongated-circle, a substantially half ellipse, a substantially half circle, or the like. Further, many radial ridges (not shown) for preventing slips are integrally formed in the back surface of the reinforcing portion 25 and a part of the cylindrical portion 23 corresponding to the reinforcing portion 25.

Figure 5:
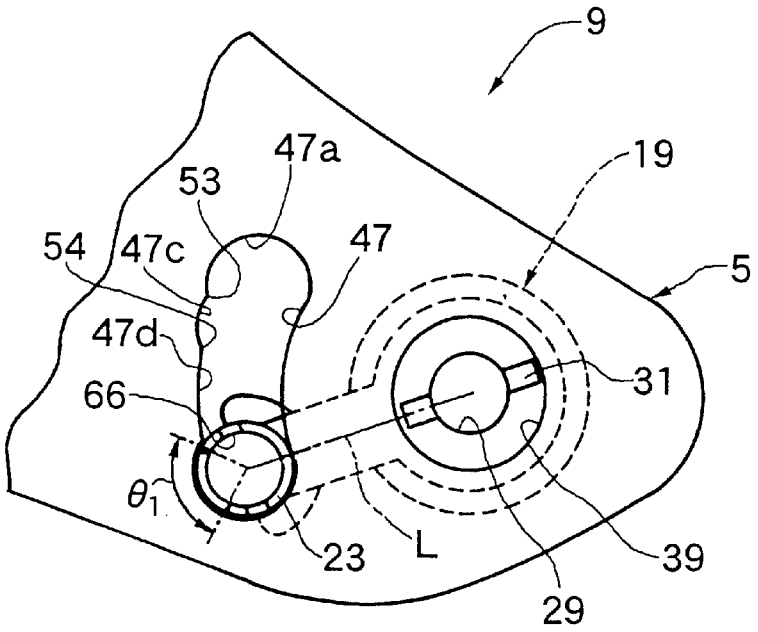
FIG. 5 is a front view similar to FIG. 4, illustrating the fully opened state of the shield plate.
Figure 10:
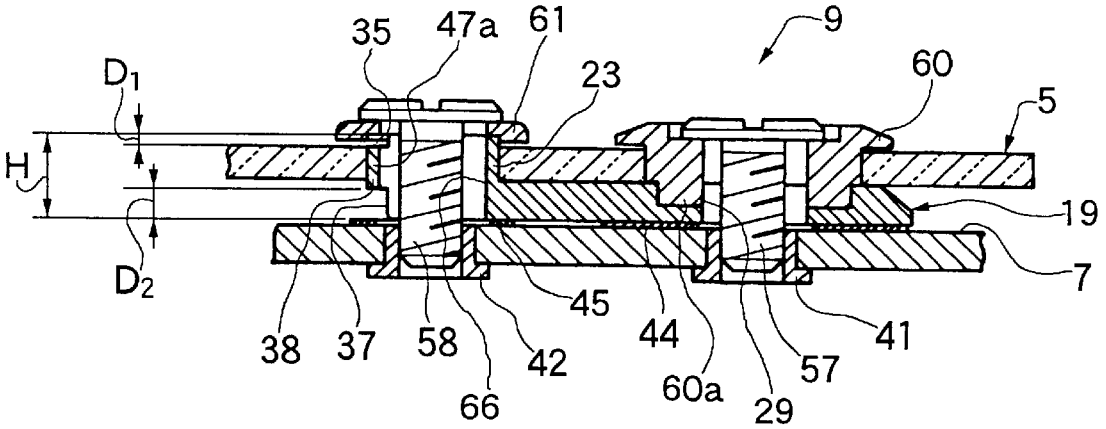
FIG. 10 is a sectional view taken along the line C—C on FIG. 6.

The upper cut 35 and the lower cut 37 serve for giving good elasticity to the cylindrical portion 23 (particularly, the far end of the cylindrical portion 23 when viewed from the side nearer to the base portion 21, in other words, one side opposite to another side nearer to the rotating center of the shield plate 5). As shown in FIG. 2, both the cuts 35, 37 are provided at the far end of the cylindrical portion 23. In the embodiment shown in FIG. 5, the cut 35, 37 is provided in the cylindrical portion 23 at an angle $\theta_1$ of about 90°, the angle $\theta_1$ being formed by two radii of the cylindrical portion 23, passing through the respective ends of the cut 35, 37. The angle $\theta_1$ is generally preferable to be within the range of 60°–120° and much preferable to be within the range of 70°–110°, so that the action of the attaching member 19 may be performed smoothly. As shown in FIG. 5, it is preferable that the two angles, into which the angle $\theta_1$ is divided by straight line L, which passes through the center of the base portion 21 and the center of the cylindrical portion 23, are substantially the same. In the embodiment, the right and the left angles, into which the angle $\theta_1$ is divided, are each about 45°. Further, in the embodiment, the depth $D_1$ of the upper cut 35 is about ⅛ of the height H of the cylindrical portion 23 (that is, the vertically measured length in FIG. 10) as shown in FIG. 10. The depth $D_1$ is generally preferable to be within the range of 1/12–¼ of the height H and much preferable to be within the range of 1/10–⅙ of the height H, so that the action of the attaching member 19 may be smoothly performed. In the embodiment, the depth $D_2$ of the lower cut 37 is about ⅜ of the height H as shown in FIG. 10. The depth $D_2$ is generally preferable to be within the range of ¼–¾ of the height H and much preferable to be within the range of 3/10–½ of the height H, so that the action of the attaching member 19 may be smoothly performed. Further, in the embodiment, the total $(D_1+D_2)$ of the depth $D_1$ of the upper cut 35 and the depth $D_2$ of the lower cut 37 is about ½ of the height H. The total $(D_1+D_2)$ is generally preferable to be within the range of ⅓–⅘ of the height H and much preferable to be within the range of ⅖–⅔, so that the action of the attaching member 19 may be smoothly performed.

Figure 7:
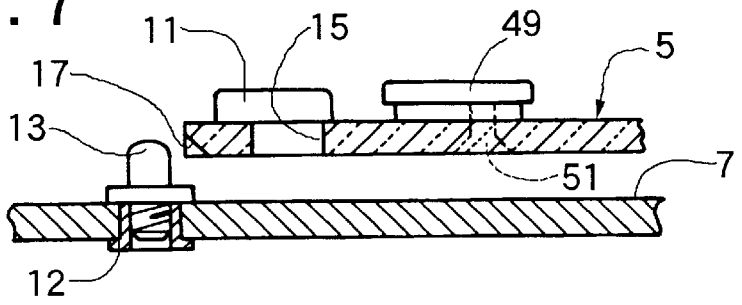
FIG. 7 is a sectional view taken along the line A—A on FIG. 3.
Figure 8:
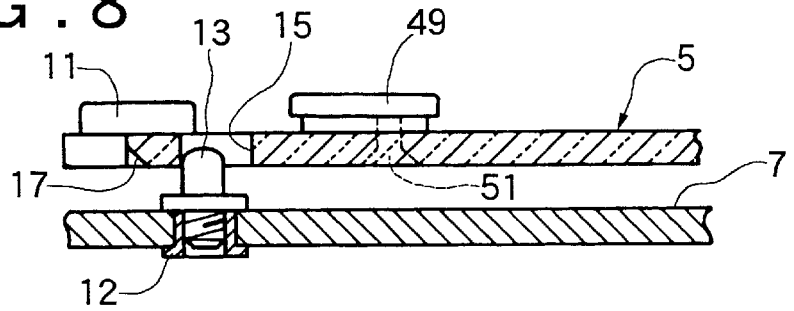
FIG. 8 is a sectional view of the shield plate attaching mechanism taken along the line A—A on the dot-dash line portion of FIG. 3.

As shown in FIG. 9, a pair of engaged apertures are provided in the outer shell 7 so as to correspond to both the base portion 21 and the cylindrical portion 23 of the attaching member 19, and a pair of female screw members 41, 42 made of hard material such as mild steel or the like are fitted into and fixed to the pair of engaged apertures, respectively. A pair of washers 44, 45 made of elastic material such as synthetic elastomer or the like are fixed, with an adhesive or the like, to the outer surface of the outer shell 7 so as to be capable of surrounding the respective female screw members (41, 42). As shown in FIG. 7, another engaged aperture is provided in the outer shell 7 and, into this engaged aperture, another female-screw member 12 is fitted. An engaging pin 13 made of hard material such as aluminum or other metal is fitted into and fixed to the female-screw member 12.

As shown in FIG. 2, the shield plate 5 has a substantially circular attaching opening 39 corresponding to the base portion 21 of the attaching member 19; an arcuated guide groove 47 shaped into a nearly circular arc, whose center substantially coincides with that of the fitting opening 39, and corresponding thereby to the cylindrical portion 23 of the attaching member 19; an engaged aperture 15 shaped into a substantially elongated-circle and corresponding to the engaging pin 13 provided in the outer shell 7; and a guiding notch 17 disposed on the inside of the shield plate 5 so as to be adjacent to the engaged aperture 15. As shown in FIG. 7, an engaging member 49 for engaging a tear-off shield film (that is, an expendable shield film, not shown), which is made of synthetic resin or the like, is secured and fixed to the shield plate 5 with a screw 51 and, also, a finger held portion 11 made of synthetic resin or the like is secured and fixed to the shield plate 5 with a screw (not shown). The finger held portion 11 is used when the person with the helmet on pushes up the shield plate 5 with his finger to move the shield plate 5.

Figure 4:
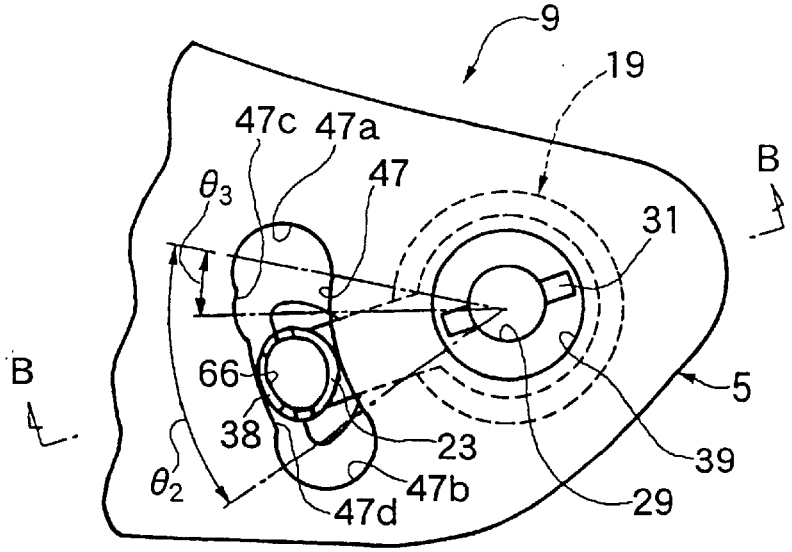
FIG. 4 is a front view, similar to FIG. 3, of the principal part of the shield plate attaching mechanism of FIG. 3, illustrating the state of the shield plate further opened at a position intermediate between the defrosted position and the fully opened position.

As shown in FIG. 4, the arcuated guide groove 47 has an engaged opening 47*a* for keeping in the fully closed condition, and an engaged opening 47*b* for keeping in the fully opened condition at both the ends thereof, respectively, and also has an engaged opening 47*c* for keeping in the defrosted condition, which is provided to partially overlap and communicate with the engaged opening 47*a*. Further, an arcuated groove 47*d* shaped into a substantially circular arc form and being substantially uniform in width is provided between the engaged opening 47*c* for keeping in the defrosted condition and the engaged opening 47*b* for keeping the full opened condition, and the inner side edge of the arcuated guide groove 47 (that is, the edge nearer to the attaching opening 39) comprises a substantially smooth curve 62 (shaped into a substantially circular arc form), which extends from the engaged opening 47*a* to the engaged opening 47*b*. As shown in FIG. 2, the outer side edge of the arcuated guide groove 47 (that is, the edge far from the attaching opening 39) has one pointed protrusion 53 forming the boundary between the engaged openings 47*a* and 47*c*, the other pointed protrusion 54 forming the boundary between the engaged opening 47*c* and the arcuated groove 47*d*, and a further pointed protrusion 55 forming the boundary between the arcuated groove 47*d* and the engaged opening 47*b*, and only the outer edge of the arcuated groove 47*d* makes a substantially smooth curve 63 (shaped into a substantially circular arc form as shown in FIG. 2).

In the embodiment shown in FIG. 4, the angle $\theta_2$ of between the center of the first engaged opening 47*a* and the center of the second engaged opening 47*b*, formed by an angular spread at the predetermined pivot is about 45°. The angle $\theta_2$ is generally preferable to be within the range of 30°–60° and it is much preferable to be within the range of 35°–55°, so that the action of the attaching member 19 may be smoothly performed. Further, in the embodiment shown in FIG. 4, the angle $\theta_3$ of between the center of the first engaged opening 47*a* and the center of the third engaged opening 47*c*, formed by an angular spread at the predetermined pivot is about 10°. The angle $\theta_3$ is generally preferable to be within the range of 6°–15° and it is much preferable to be within the range of 8°–13°, so that the shield plate 5 may be kept well in the defrosting position. In the embodiment shown in FIG. 4, the ratio of angle $\theta_3$ to angle $\theta_2$ (that is, $\theta_3/\theta_2$) is ⅔. The ratio is generally preferable to be within the range of ⅙–⅘ and the ratio is much preferable to be within the range of 3/18–⅗, so that the action of the attaching member 19 may be smoothly performed and the shield plate 5 may be kept well in the defrosting position. In the embodiment shown in FIG. 6, the angle $\theta_4$ of the arcuated groove 47*d*, formed by an angular spread at the predetermined pivot (in other words, formed by two radii of the attaching opening 39, passing through the pair of pointed protrusions 54, 55) is about 23°. The angle $\theta_4$ is generally preferable to be within the range of 15°–35° and the angle $\theta_4$ is much preferable to be within the range of 18°–30°, so that the action of the attaching member 19 may be smoothly performed and the shield plate 5 may be kept well in the defrosting position. The ratio of the width of the arcuated groove 47*d* to each diameter of the engaged opening 47*a*, 47*b*, 47*c* (it is nearly equal to the ratio of the width of the arcuated groove 47*d* to the diameter of the cylindrical portion 23 of the attaching member 19) is about 93/100. The ratio is generally preferable to be within the range of 80/100–97/100 and the ratio is much preferable to be within the range of 85/100–95/100, so that the action of the attaching member 19 may be smoothly performed.

In the embodiment, the engaged opening 47*a*, 47*b*, 47*c* is of substantially circular shape and nearly equal to or a little larger than that of the cylindrical portion 23 of the attaching member 19. However, the form of the engaged opening 47*a*, 47*b*, 47*c* is not necessarily of substantially circular shape. The form may be of substantially elongated circular shape, substantially elliptical shape, substantially rectangular shape with cutoff corners, or the like as the cylindrical portion 23 is so. Particularly, it is preferable that the form of the engaged opening 47*a*, 47*b*, 47*c* varies in accordance with that of the cylindrical portion 23.

There will be described hereinafter how to attach the shield plate 5 and the attaching member 19 to the outer shell 7. It is noted that a pair of screws 57, 58 and a pair of washers 60, 61 are used when the shield plate 5 and the attaching member 19 are attached. The screw 57, 58 and washer 60 may be made of synthetic resin such as polycarbonate resin or polyacetal resin, or metal such as aluminum or other metal, and the washer 61 is also made of synthetic resin such as polycarbonate resin, polyacetal resin or the like.

Firstly, the tip of the screw 57 used as a supporting shaft is inserted, in turn, into the central aperture 64 of the washer 60, the attaching opening 39 of the shield plate 5, and the central aperture 29 of the base portion 21 of the attaching member 19, and screwed into the female screw member 41 until the screw 57 is fixed (see FIG. 10). In that event, the upper end of the cylindrical portion 23 of the attaching member 19 is inserted into the arcuated guide groove 47 of the shield plate 5, and a pair of protrusion 60*a* projecting from the lower surface of the washer 60 is fitted into the pair of engaging grooves 31 of the base portion 21. Thus, the washer 60 and the base portion 21 of the attaching member 19 are pressed against the washer 44 of the outer shell 7 by the head of the screw 57 until they are fixed as shown in FIG. 10, and the shield plate 5 is rotatably supported by the washer 60 (that is, the central axis of the washer 60 serves as the axis of rotation) between the surface of the base portion 21 of the attaching member 19 and the head portion of the washer 60.

Secondly, the tip of the screw 58 used as a fixed axis is inserted, in turn, into the central aperture 65 of the washer 61 and the central aperture 66 of the cylindrical portion 23 of the attaching member 19 (fitted into the arcuated guide groove 47 of the shield plate 5), and the screw 58 is screwed into the female screw member 42 of the outer shell 7 until the screw 58 is fixed as shown in FIG. 10. In that event, a pair of protrusions 61*a* projecting from the lower surface of the washer 61 are fitted into the pair of engaging slits 33 of the cylindrical portion 23. Thus, the washer 61 and the cylindrical portion 23 of the attaching member 19 are pressed against the washer 45 of the outer shell 7 by the head of the screw 58 until they are fixed as shown in FIG. 10. In that event, the shield plate 5 is kept holding between the surface of the connecting portion 25 and the washer 61 so as to slide the outer periphery of the cylindrical portion 23 along the inner and outer side edges of the arcuated guide groove 47 whenever the shield plate 5 is moved and, in that state, the easily bendable portion 38 provided in the cylindrical portion 23 of the attaching member 19 is positioned at the distal end side of the attaching member 19.

In the full-face-type helmet constituted as described above, if the shield plate 5 undergoes rotary motion on the central axes of the screw 57 and the washer 60 and the cylindrical portion 23 of the attaching member 19 relatively slides along the arcuated guide groove 47 of the shield plate 5, it becomes possible as described hereinafter to keep the shield plate 5 holding in its fully closed position, its defrosted position (that is, its blur preventing position, its blur removing position, its frost preventing position and/or its frost removing position), its arbitrarily opened position, and its fully opened position. It is to be noted in the above description that "the fully closed position" of the shield plate 5 does not necessarily mean that the window opening 3 is completely closed by the shield plate 5. It may be sufficient if the window opening 3 is practically closed. Further, it is to be noted that "the fully opened position" of the shield plate 5 does not necessarily mean that the window opening 3 is completely opened by the shield plate 5. It may be sufficient if the window opening 3 is practically opened.

Figure 6:
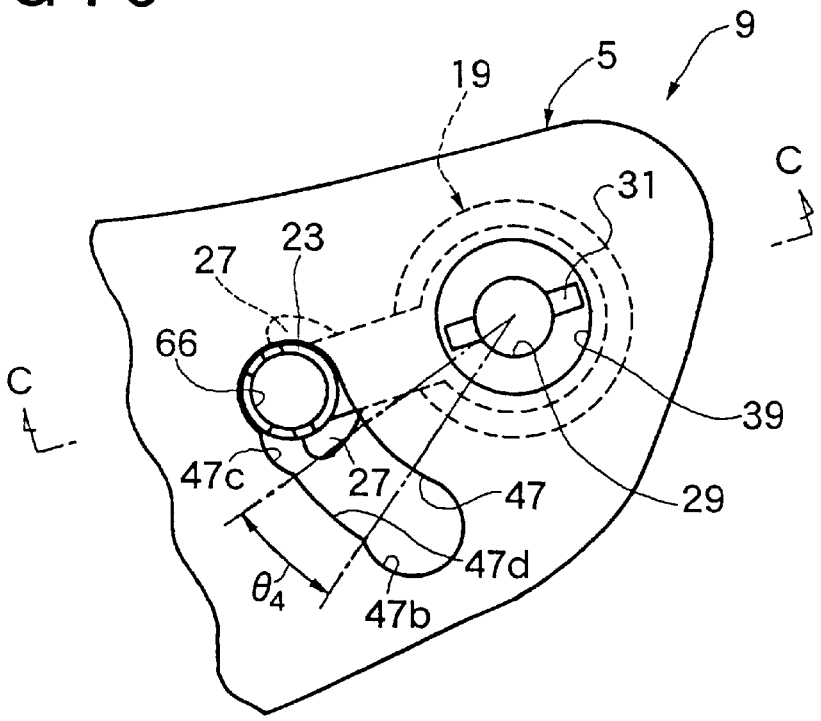
FIG. 6 is a front view similar to FIG. 4, illustrating the fully closed state of the shield, plate.

That is, when the cylindrical portion 23 is kept holding in the engaged opening 47*a* of the guide groove 47 to almost remain its original form as shown in FIGS. 6 and 10, the shield plate 5 is in its fully closed position. In that event, the engaging pin 13 of the outer shell 7 is fitted into the engaged aperture 15 of the shield plate 5 as indicated by dot-dash lines in FIG. 3, so that the shield plate 5 can be held surely in its fully closed position. Since the guiding notch 17 disposed in the inner side surface of the shield plate 5 is slanted upward from the lower end of the shield plate 5 so that the depth of the guiding notch 17 may become gradually shallow as shown in FIG. 7, the engaging pin 13 to be relatively moved on the notch 17 can be fitted easily and surely into the engaged aperture 15.

Figure 3:
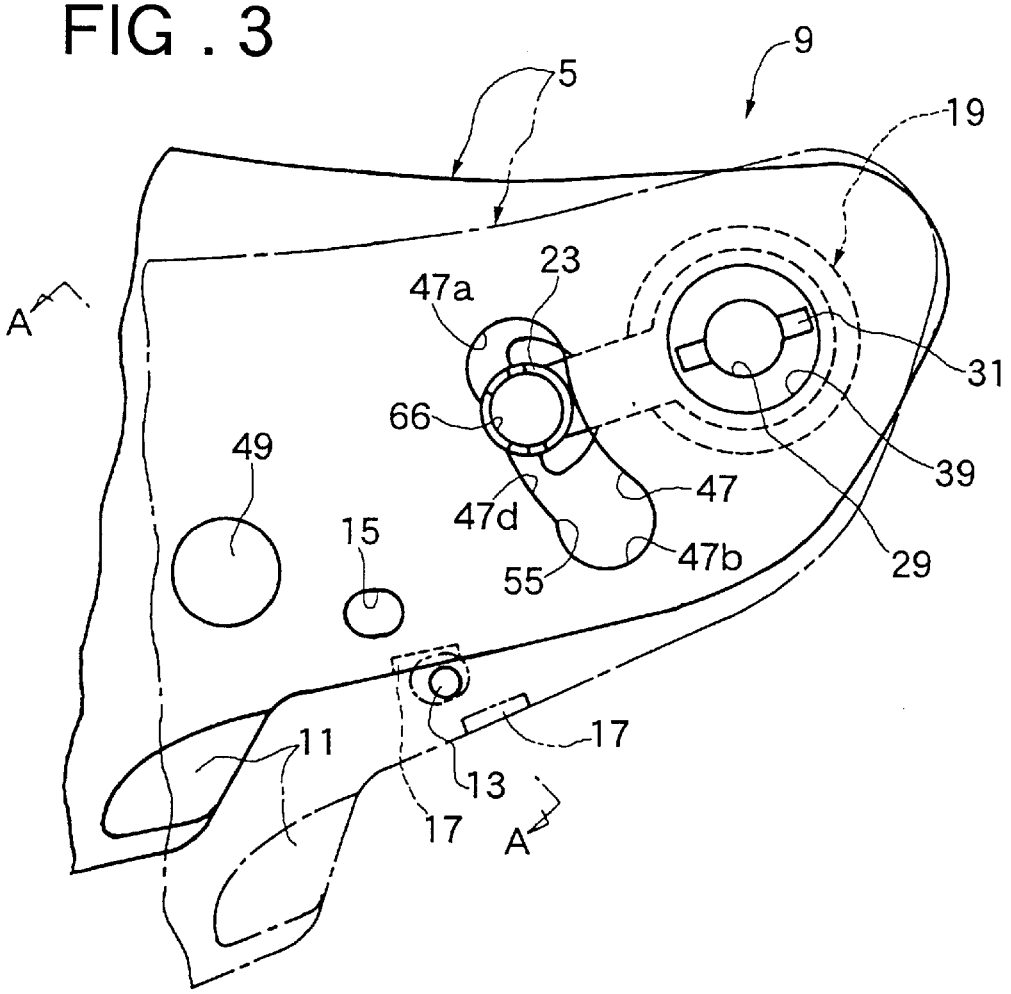
FIG. 3 is a front view of the shield plate attaching mechanism of FIG. 2, illustrating the state of the shield plate opened a little at the defrosted position.

In the fully closed state (indicated by dot-dash lines in FIGS. 1 and 3, and shown in FIGS. 8 and 10), when the person with the helmet on presses the finger held portion 11 of the shield plate 5 with his finger to rotate the shield plate 5 obliquely upward as indicated by continuous line in FIG. 3 and shown in FIG. 7, the engaging pin 13 relatively comes out of the engaged aperture 15, and the cylindrical portion 23 is fitted into the engaged opening 47*c*, so that the shield plate 5 lies in its defrosted position, where the window opening 3 of the head protector 1 is opened a little. When the shield plate 5 is further rotated, the cylindrical portion 23 fitted into the arcuated guide groove 47 relatively moves from engaged opening 47*c* to engaged opening 47*b* through the arcuated groove 47*d*. When the cylindrical portion 23 relatively passes through the protrusions 53, 54 and the arcuated groove 47*d*, in which the width is comparatively narrow, the diameter of the cylindrical portion 23 decreases in the direction of line L shown in FIG. 5, so that the cylindrical portion 23 can pass through the above narrow width portions.

In that event, the upper surface of the cylindrical portion 23 partially lacking for the upper cut 35 is pressed against the washer 61, and the lower surface of the cylindrical portion 23 partially lacking for the lower cut 37 is pressed against the washer 45. Further, the lower end of the cylindrical portion 23 is connected to the pair of reinforcing portions 27 and the connecting portion 25 on the side nearer to the fitting opening 39, whereby the side nearer to the fitting opening 39 is rigid enough. Accordingly, the above-described contraction, in diameter, of the cylindrical portion 23 mainly depends upon the bending deformation of the easily bendable portion 38. In addition, when the cylindrical portion 23 relatively passes through the arcuated groove 47*d*, the cylindrical portion 23 is smoothly moved without any uneasiness, because the arcuated groove 47*d* is shaped into a substantially circular arc. Thus, the shield plate 5 can be opened and closed with dulcet clicks. When the cylindrical portion 23 is set in an arbitrary position of the arcuated groove 47*d*, the cylindrical portion 23 can be kept holding there in a comparatively good condition, because the cylindrical portion 23 is elastically sandwiched due to its resilience (particularly, the resilience of the easily bendable portion 38). Thus, the shield plate 5 can be kept not only holding surely in its defrosted position, where the window opening 3 of the head protector 1 is opened a little, and its practically fully opened position, but also holding almost surely in an arbitrarily opened position that is intermediate between the defrosted position and the practically fully opened position.

Figure 11:
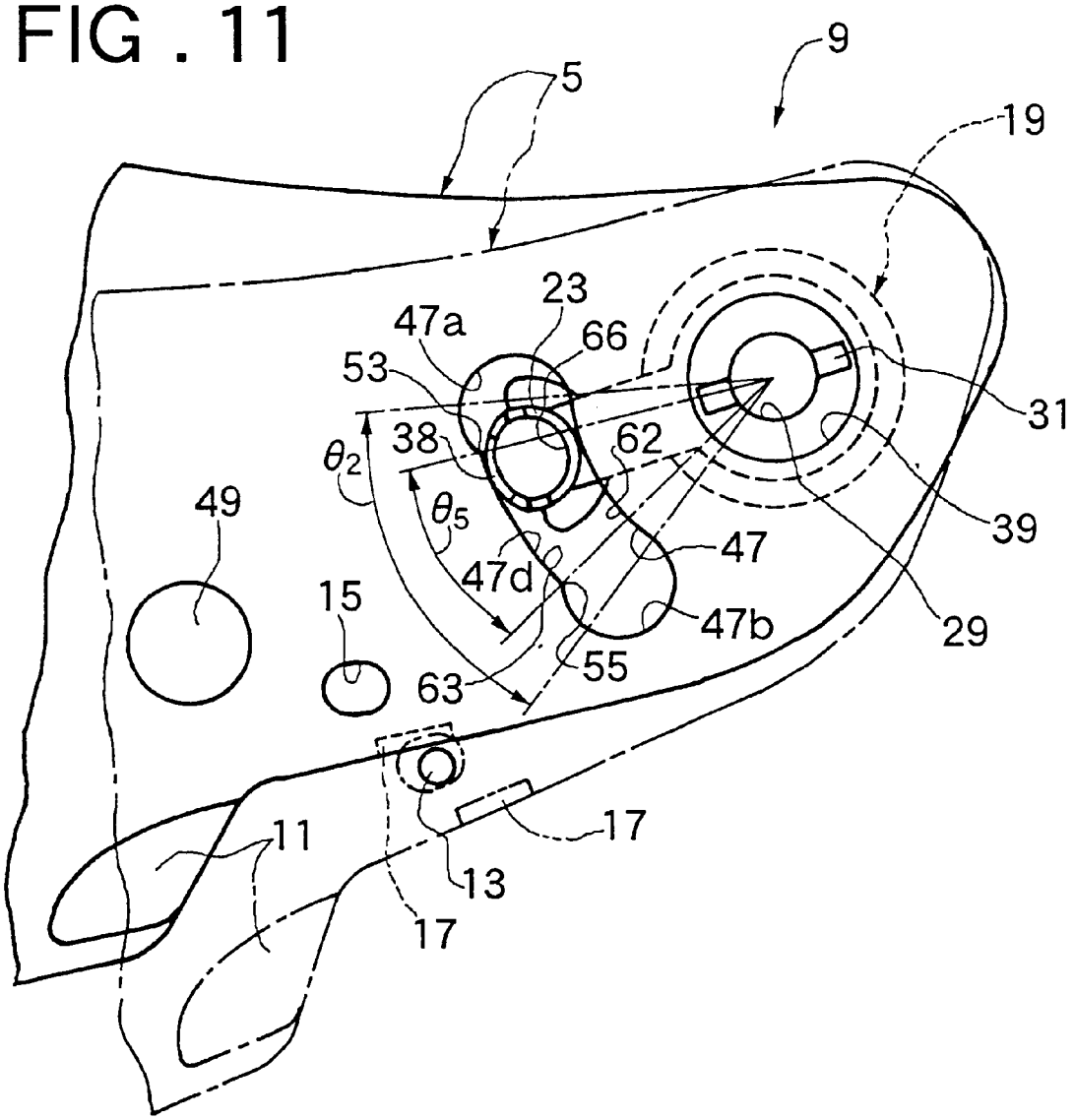
FIG. 11 is a front view, similar to FIG. 3, of a shield plate attaching mechanism according to a second embodiment, in which the present invention is applied to a shield plate attaching mechanism of a full-face-type helmet.

Referring to FIG. 11, a second embodiment in which the present invention is applied to a shield plate attaching mechanism of a full-face-type helmet will be described hereinafter. In the shield plate attaching mechanism according to the second embodiment of the present invention, the constitution thereof is practically the same as the one according to the first embodiment shown in FIGS. 1–10, excepting the form of a nearly circular guide groove 47, so that the above-described explanation of the shield plate attaching mechanism shown in FIGS. 1–10 can be also applied to the explanation of the shield plate attaching mechanism shown in FIG. 11, excepting an explanation described hereinafter in connection with the above different point. Further, in both the first and the second embodiments, the same numbers will be used to identify the members if there are common members between them, and their explanation will be omitted.

In the shield plate attaching mechanism 9 according to the second embodiment, the shield plate 5 is kept not surely holding in a specific defrosted position, so that, in the second embodiment, no engaged opening 47*c* for keeping in the defrosted condition is provided in the arcuated guide groove 47. In other words, the arcuated guide groove 47 shaped into a nearly circular arc has the engaged opening 47*a* for keeping in the fully closed condition at one end thereof, and the engaged opening 47*b* for keeping in the fully opened condition at the other end and, between both the engaged openings 47*a* and 47*b*, an arcuated groove 47*d* shaped into a substantially circular arc and having a substantially uniform width is formed. The outer side edge of the arcuated guide groove 47 shaped into the nearly circular arc comprises a substantially smooth curve 63 (that is, a nearly circular arc) extending from the pointed protrusion 53 to the pointed protrusion 55. In the embodiment shown in FIG. 11, the angle $\theta_5$ of the arcuated groove 47*d*, formed by an angular spread at the predetermined pivot is about 30°. The angle $\theta_5$ is generally preferable to be within the range of 20°–45° and it is much preferable to be within the range of 24°–40°, so that the action of the attaching member 19 may be smoothly performed.

Thus, in the shield plate attaching mechanism 9 shown in FIG. 11, the shield plate 5 can be surely kept holding in the fully closed position where the window opening 3 of the head protector 1 is practically fully closed and in the fully opened position where the window opening 3 is practically fully opened, like the shield plate attaching mechanism shown in FIGS. 1–10. Further, the shield plate 5 can be almost surely kept holding in an arbitrarily opened position (including the defrosted position), which lies between the fully closed position and the fully opened position. It is noted that how to set the shield plate 5 in its arbitrarily opened position will be easily understood by the explanation referring to FIG. 4 in the first embodiment.

In the shield plate attaching mechanism 9 shown in FIG. 11, the defrosted position of the shield plate 5 is not specified but can be adjustably selected, so that the person with the helmet on can select very easily an arbitrarily defrosted position so as to fit the weather or other conditions.

Having described specific preferred embodiments of the present invention with reference to the accompanying drawings, it is to be understood that the invention is not limited to that precise embodiments, and that various changes and modifications may be effected therein by one skilled in the art without departing from the scope or spirit of the invention as defined in the appended claims.

For example, in the above embodiments, the present invention is applied to the shield plate attaching mechanism of the full-face-type helmet, but the present invention is also applied to a jet-type helmet, a semi-jet-type helmet or the like. Further, the present invention is applied to a mechanism for attaching a visor, too.

In the above embodiments, the single easily bendable portion 38 is formed between the upper cut 35 and the lower cut 37, but a plurality of easily bendable portions may be provided by means of disposing laterally longer one or plural slits between those cuts 35 and 37. It is noted that the slits disposed between the cuts 35, 37 of the easily bendable portion 38 nearly correspond to each other in upper side and lower side relations. Further, in lieu of, or in addition to the above slit, a plurality of small apertures may be formed in the easily bendable portion.

I claim:

1. A helmet, comprising:

a rotating plate available for a windshield and/or a sunshade, which is attached to a head protector so as to be rotatable about a predetermined pivot;

an arcuate guide groove provided in the rotating plate, which is substantially an arc of a circle, the center of the circle substantially coinciding with that of the predetermined pivot; and a positioning member attached to the head protector and inserted into the arcuate guide groove so as to be relatively slidable within and along the arcuate guide groove when the rotating plate is rotated; and wherein the positioning member has a first cut and a second cut formed in substantially opposed relation to each other at upper and lower ends of the positioning member, respectively, to provide a bendable portion between the first cut and the second cut of the positioning member.

2. A helmet according to claim 1, wherein:

an attaching member is disposed for locating the positioning member;

the attaching member has a base portion, the positioning member, and a connecting portion that connects the base portion with the positioning member;

the base portion is attached to the head protector with a supporting shaft; and the easily bendable portion is provided on one side of the positioning member, which is opposite to another side nearer to the predetermined pivot.

3. A helmet according to claim 2, wherein:

the base portion is attached to the head protector with the supporting shaft that rotatably supports the rotating plate on the head protector, whereby the base portion lies between the head protector and the rotating plate.

4. A helmet according to claim 2, wherein:

the attaching member further has a pair of right and left reinforcing portions that extend from the positioning member to the connecting portion and laterally spread like gills on the right and left sides of their boundary and its vicinity.

5. A helmet according to claim 1, wherein:

the first cut and the second cut are provided in the positioning member each at an angle of 60°–120°, the angle being formed by two radii of the positioning member, passing through the respective side ends of each cut.

6. A helmet according to claim 5, wherein:

the first cut and the second cut are provided in the positioning member each at an angle of 70°–110°, the angle being formed by the two radii of the positioning member, passing through the respective side ends of each cut.

7. A helmet according to claim 1, wherein:

the total of the depth of the first cut and the depth of the second cut is within the range of 1/3 to 4/5 of the height of the positioning member.

8. A helmet according to claim 7, wherein:

the total of the depth of the first cut and the depth of the second cut is within the range of 2/5–2/3 of the height of the positioning member.

9. A helmet according to claim 1, wherein:

the arcuate guide groove has a first engaged opening for keeping the rotating plate in the fully closed condition, which is provided at one end of the arcuate guide groove, and a second engaged opening for keeping the rotating plate in the fully opened condition, which is provided at the other end of the arcuate guide groove;

wherein said arcuate guide groove is of substantially uniform width and comprises means by which said first and second engaged openings communicate with each other;

wherein the positioning member is held by the first and second engaged openings so as to substantially retain its original form when it is fitted into either of the engaged openings; and wherein the positioning member is less elastically deformed when fitted into any of the engaged openings than when fitted into the remainder of the arcuate guide groove.

10. A helmet according to claim 9, wherein the first and second engaged openings are each of substantially circular-shape.

11. A helmet according to claim 10, wherein the ratio of the width of the arcuate arcuate guide groove to the diameter of either of the first or second engaged openings is within the range of 80/100 to 97/100.

12. A helmet according to claim 11, wherein the ratio is within the range of 85/100–95/100.

13. A helmet according to claim 9, wherein the inner side edge of the arcuate guide groove, which is nearer to the predetermined pivot, comprises a substantially smooth arcuate curve that is shaped into an arc of a circle and extends from the first engaged opening for keeping the rotating plate in the fully closed condition to the second engaged opening for keeping the rotating plate in the fully opened condition, the center of the circle substantially coinciding with that of the predetermined pivot.

14. A helmet according to claim 9, wherein an angle that the arcuate arcuate guide groove forms about the predetermined pivot as the center is within the range of 20°–45°.

15. A helmet according to claim 14, wherein the angle is within the range of 24°–40°.

16. A helmet comprising:

a rotating plate available for a windshield and/or a sunshade, which is attached to a head protector so as to be rotatable about a predetermined pivot;

an arcuate guide groove provided in the rotating plate, which is substantially an arc of a circle the center of the circle substantially coinciding with that of the predetermined pivot; and a substantially tubular positioning member attached to the head protector and inserted into the guide groove so as to be relatively slidable along the arcuate guide groove when the rotating plate is rotated;

wherein the arcuate guide groove has a first engaged opening for keeping the rotating plate in a fully closed condition, which first engaged opening is provided at one end of the arcuate guide groove, a second engaged opening for keeping the rotating plate in a fully opened condition, which second engaged opening is provided at the other end of the arcuate guide groove, a third engaged opening for keeping the rotating plate in a defrosted condition, which third engaged opening is provided to be near to and partially overlap with the first engaged opening;

wherein said arcuate guide groove is substantially uniform in width and comprises means by which the second engaged opening and the third engaged opening communicate with each other;

wherein the substantially tubular positioning member is held by the three engaged openings so as to substantially retain its original form when it is fitted into any of the engaged openings; and wherein the substantially tubular positioning member is elastically deformed by the arcuate guide groove when it is not fitted into any of the engaged openings.

17. A helmet according to claim 16, wherein the first, the second and the third engaged openings are each of substantially circular shape.

18. A helmet according to claim 17, wherein the ratio of the width of the arcuated groove to each diameter of the three engaged openings is within the range of 80/100–97/100.

19. A helmet according to claim 18, wherein the ratio of the width of the arcuated groove to each diameter of the three engaged openings is within the range of $^{85}/_{100}$–$^{95}/_{100}$.

20. A helmet according to claim 16, wherein an angle between the center of the first engaged opening and the center of the second engaged opening, formed by an angular spread at the predetermined pivot is within the range of 30°–60°.

21. A helmet according to claim 20, wherein the angle between the center of the first engaged opening and the center of the second engaged opening, formed by an angular spread at the predetermined pivot is within the range of 35°–55°.

22. A helmet according to claims 16, wherein an angle between the center of the first engaged opening and the center of the third engaged opening, formed by an angular spread at the predetermined pivot is within the range of 6°–15°.

23. A helmet according to claim 22, wherein the angle between the center of the first engaged opening and the center of the third engaged opening, formed by an angular spread at the predetermined pivot is within the range of 8°–13°.

24. A helmet according to claim 16, wherein an angle, which the arcuate guide groove forms about the predetermined pivot as the center, is within the range of 15°–35°.

25. A helmet according to claim 24, wherein the angle, which the arcuate guide groove forms about the predetermined pivot as the center, is within the range of 18°–30°.

26. A helmet according to claim 16, wherein a first cut and a second cut are formed in substantially opposed relation to each other at an upper end and a lower end of the positioning member, respectively, to provide an easily bendable portion between the first cut and the second cut of the positioning member.

27. A helmet according to claim 16, wherein:

an attaching member is disposed for locating the positioning member;

the attaching member has a base portion, the positioning member, and a connecting portion that connects the base portion with the positioning member;

the base portion is attached to the head protector with a supporting shaft; and a bendable portion is provided on one side of the positioning member, which is opposite to another side nearer to the predetermined pivot.

28. A helmet according to claim 27, wherein the base portion is attached to the head protector with the supporting shaft that rotatably supports the rotating plate on the head protector, whereby the base portion lies between the head protector and the rotating plate.

29. A helmet according to claim 16, wherein an inner side edge of the arcuate guide groove, which is nearer to the predetermined pivot, comprises a substantially smooth curve which is shaped into substantially an arc of a circle and extends from the first engaged opening to the second engaged opening, the center of the circle substantially coinciding with that of the predetermined pivot.

* * * * *